US005738983A

United States Patent [19]

Smith et al.

[11] Patent Number: 5,738,983

[45] Date of Patent: Apr. 14, 1998

[54] PHOTOGRAPHIC IMAGING ELEMENT CONTAINING MATTING AGENTS

[75] Inventors: Dennis Edward Smith; Alfred Bruce Fant; John Leonard Muehlbauer, all of Rochester; Yongcai Wang, Penfield, all of N.Y.

[73] Assignee: Eastman Kodak Company, Rochester, N.Y.

[21] Appl. No.: 633,281

[22] Filed: Apr. 16, 1996

Related U.S. Application Data

[60] Provisional application No. 60/004,231, Sep. 25, 1995.

[51] Int. Cl.[6] ..... G03C 1/76

[52] U.S. Cl. ..... 430/536; 430/537; 430/950; 430/961; 430/523; 430/9

[58] Field of Search ..... 430/523, 536, 430/537, 950, 961, 9

[56] References Cited

U.S. PATENT DOCUMENTS

| | | | |
|---|---|---|---|
| 4,142,894 | 3/1979 | Hori et al. | 430/950 |
| 4,294,739 | 10/1981 | Upson et al. | 430/527 |
| 4,447,525 | 5/1984 | Vallarino et al. | 430/523 |
| 4,992,357 | 2/1991 | Haga et al. | 430/537 |
| 5,279,934 | 1/1994 | Smith et al. | 430/950 |
| 5,370,982 | 12/1994 | Tashiro et al. | 430/536 |
| 5,378,577 | 1/1995 | Smith et al. | 430/961 |
| 5,550,011 | 8/1996 | Fant et al. | 430/523 |
| 5,595,862 | 1/1997 | Fant et al. | 430/537 |

*Primary Examiner*—Geraldine Letscher
*Attorney, Agent, or Firm*—Robert A. Gerlach; Carl F. Ruoff

[57] ABSTRACT

A photographic imaging element comprising a support, at least one light-sensitive silver halide layer, and a light-insensitive layer comprising a polymer particle of the formula:

$$(A)_x(B)_y(C)_z \qquad (I)$$

where A is a polyfunctional ethylenically unsaturated crosslinking monomer, B is an ethylenically unsaturated monomer containing carboxylic acid groups, C is a monofunctional ethylenically unsaturated monomer other than B, x is about 0.1 to 2 mole percent, y is about 35 to 70 mole percent and z equals 100–(x+y) mole percent.

10 Claims, 1 Drawing Sheet

PHOTOGRAPHIC IMAGING ELEMENT CONTAINING MATTING AGENTS

CROSS REFERENCE TO RELATED APPLICATION

Reference is made to and priority claimed from U.S. Provisional Application Ser. No. 60/004,231, filed 25 Sep. 1995, entitled PHOTOGRAPHIC IMAGING ELEMENT CONTAINING MATTING AGENTS.

FIELD OF THE INVENTION

This invention relates to photographic imaging elements and particularly to silver halide photographic elements containing matting agents.

BACKGROUND OF THE INVENTION

It is conventional to incorporate finely powdered grains or matting agents into the protective layer of a photographic element to increase the surface roughness to achieve the following: (1) reduce self-adhering of the material, (2) reduce sticking of the material to manufacturing and processing devices, (3) improve the antistatic properties of the material, and (4) improve the vacuum adhesiveness of the material in contact exposure to prevent Newton's rings. The matting agents are commonly very small particles of organic or inorganic materials, such as silicone dioxide, magnesium oxide, titanium dioxide, calcium carbonate, poly(methyl methacrylate), poly(vinyltoluene), poly(methyl methacrylate-co-methacrylic acid), and so on.

Matting of the protective layer suffers, however, from various disadvantages. For example, it reduces the transparency of the photographic elements after processing and increases the graininess of the picture. It has been heretofore known to include processing removable polymer particles, sometimes referred to as soluble matte, in protective layers. High concentrations of processing removable matte are needed especially when the unprocessed photographic elements are used or stored at high relative humidities and at elevated temperatures of from 30° to 40° C. High concentrations are also needed to prevent contact specks which cause adverse sensitometric defects when the unprocessed materials are rolled up.

The use of a high level of processing removable matte provides a satisfactory solution to conventional films for amateur use, for which the processed, or developed, film strips are returned to the consumer in synthetic resin pouches, or sleeves, where the frontside and backside of the film do not come in contact with each other.

Recent patents have disclosed photographic systems where the processed element may be re-introduced into a cassette. This system allows for compact and clean storage of the processed element until such time when it may be removed for additional prints or to interface with display equipment. Storage in the cassette is preferred to facilitate location of the desired exposed frame and to minimize contact with the negative during subsequent usage. U.S. Pat. No. 5,173,739 discloses a cassette designed to thrust the photographic element from the cassette, eliminating the need to contact the film with mechanical or manual means. Published European Patent Application 0 476 535 A1 describes how the developed film may be stored in such a cassette. The dimensions of such a so-called thrust cassette requires that the processed photographic element is wound tightly and under pressure, causing direct close contact between the front and back sides which results in ferrotyping, especially at high temperature and high relative humidity. Processing removable matte does not prevent this problem.

In recent years, rapid processing and high temperature drying after processing have become common practice for photographic materials. The high temperature dried films, for example 60° C. (harsh drying), tend to aggravate ferrotyping which results from close contact, especially under elevated humidity and temperature. When ferrotyping is sufficiently severe, the resulting prints are unacceptable. Films dried at lower temperatures, for example 40° C. (mild drying), tend to show much less ferrotyping. The reason for this difference is not understood.

DESCRIPTION OF RELATED ART

It has been heretofore known to employ matting agents in photographic materials that include a degree of crosslinking and acid functional groups to prevent settling of the matting agent in the coating solution and which does not generate a stain in the processing solution.

SUMMARY OF THE INVENTION

Therefore, an objective of the present invention is to provide a silver halide photographic element capable of being rehoused in a cartridge after processing which has excellent image quality and low printing granularity, and superior resistance to sticking and ferrotyping between its front and backsides at high temperatures and in moist environments.

In accordance with this invention, a photographic imaging element comprises a support, at least one light-sensitive silver halide layer, and a light-insensitive layer comprising a polymer particle of the formula:

$$(A)_x(B)_y(C)_z \qquad (I)$$

where A is a polyfunctional ethylenically unsaturated crosslinking monomer, B is an ethylenically unsaturated monomer containing carboxylic acid groups, C is a monofunctional ethylenically unsaturated monomer other than B, x is about 0.1 to 2 mole percent, y is about 35 to 70 mole percent and z equals 100–(x+y) mole percent.

The polymer particles in accordance with this invention can be included in any layer of the imaging element, but preferably are included in the protective layer of the imaging element, in a separate light-insensitive layer over the protective layer of the imaging element, or in a layer in close proximity to the top-most protective layer so that the polymer matte particles protrude above the surface of the top-most layer of the imaging element. The polymer matte particles have a mean size of from 0.5 to 10μ, preferably from 0.5 to 6μ, and most preferably from 0.8 to 3μ.

The utilization of elements in accordance with the above unexpectedly provides excellent image quality and low printing granularity with superior resistance to sticking and ferrotyping.

DESCRIPTION OF PREFERRED EMBODIMENTS

Figure 1:
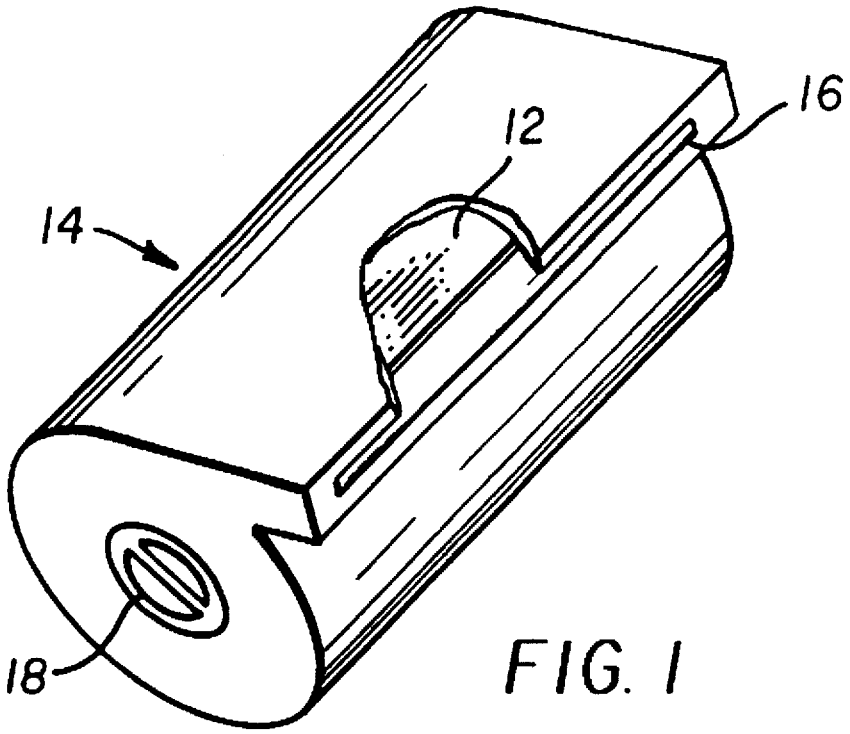
FIG. 1 is a partially cutaway perspective view of a cassette containing a photographic element in accordance with this invention.

Photographic elements in a cassette are shown generally in U.S. Pat. No. 5,173,730 and in the attached FIG. 1. In FIG. 1, the film material includes a photographic element 12 encased in a suitable cassette 14. The cassette includes an inlet/outlet 16 for entrance and exit of the photographic element 12 into and out of the cassette 14. The photographic element 12 may be wound upon a suitable spool 18 or on itself (not shown).

Photographic elements according to this invention can differ widely in structure and composition. For example, they can vary greatly in regard to the type of the support, the number and composition of the imaging forming layers, and the kinds of auxiliary layers that are included in the elements. Typical supports include cellulose nitrate film, cellulose acetate film, poly(vinyl acetal) film, polystyrene film, poly(ethylene terephthalate) film, poly(ethylene naphthalate film, polycarbonate film, and the like.

In accordance with the present invention, the matte particles have a composition given by formula I, in which A is a polyfunctional ethylenically unsaturated crosslinking monomer, B is an ethylenically unsaturated monomer containing carboxylic acid groups, C is a monofunctional ethylenically unsaturated monomer other than B, x is about 0.1 to 2 mole percent, preferably from 0.5 to 2 mole percent, y is about 35 to 70 mole percent, preferably from 35 to 60 mole percent, and z equals 100–(x+y) mole percent. While the matting agent may be incorporated into any layer of the element, it is preferably incorporated into the surface protective layer of the element. By surface protective layer is meant either the emulsion side surface protective layer, or the backing side surface protective layer, or both. However, it is particularly preferable to incorporate the matting agent in the outermost emulsion side surface protective layer. For the purpose of simplicity in explanation, the terms "protective layer" and "surface protective layer" will be used throughout this specification. However, it is to be understood that the matting agents may be employed in any light-insensitive layer. The matting agent of the present invention is employed at a coating weight coverage of 0.001 to 0.3 $g/m^2$, preferably from 0.002 to 0.2 $g/m^2$, and most preferably from 0.005 to 0.15 $g/m^2$.

The protective layer of the present invention can be coated directly on the top of a light-sensitive layer or can be used together with an ultraviolet ray protective layer or an interlayer. In general, the outermost protective layer of the present invention has a thickness of from 0.2 to 3 μm, and preferably from 0.5 to 2 μm, and most preferably from 0.6 to 1.5 μm. A very thick protective layer will diminish the matting effect and a very thin layer will adversely affect the matte particle adhesion.

The matte particles for use in accordance with this invention can be made by various well-known techniques in the art, such as, for example, crushing, grinding or pulverizing of polymer down to the desired size, emulsion polymerization, dispersion polymerization, suspension polymerization, solvent evaporation from polymer solution dispersed as droplets, and the like (see, for example, Arshady, R. in "Colloid & Polymer Science", 1992, No 270, pages 717–732; G. Odian in "Principles of Polymerization", 2nd Ed. Wiley(1981); and W. P. Sorenson and T. W. Campbell in "Preparation Method of Polymer Chemistry", 2nd Ed, Wiley (1968)). A suitable method of preparing matte particles in accordance with this invention is by a limited coalescence technique where polyaddition polymerizable monomer or monomers are added to an aqueous medium containing a particulate suspending agent to form a discontinuous (oil droplet) phase in a continuous (water) phase. The mixture is subjected to shearing forces, by agitation, homogenization and the like to reduce the size of the droplets. After shearing is stopped an equilibrium is reached with respect to the size of the droplets as a result of the stabilizing action of the particulate suspending agent in coating the surface of the droplets and then polymerization is completed to form an aqueous suspension of polymer particles. This process is described in U.S. Pat. Nos. 2,932,629; 5,279,934; and 5,378,577 incorporated herein by reference. Another method of preparing matte particles in accordance with this invention is by a process including forming a suspension or dispersion of ethylenically unsaturated monomer droplets in an aqueous media, and polymerizing the monomer to form solid polymer particles. Optionally, subsequent to the formation of the droplets and before the commencement of the polymerization reaction, an effective amount of a hydrophilic colloid such as gelatin can be added to the aqueous media.

Suitable polyfunctional ethylenically unsaturated crosslinking monomers which can be used as Component A of the present invention are monomers which are polyfunctional with respect to the polymerization reaction, and include esters of unsaturated monohydric alcohols with unsaturated monocarboxylic acids, such as allyl methacrylate, allyl acrylate, butenyl acrylate, undecenyl acrylate, undecenyl methacrylate, vinyl acrylate, vinyl methacrylate; dienes such as butadiene and isoprene; esters of saturated glycols or diols with unsaturated monocarboxylic acids, such as ethylene glycol diacrylate, ethylene glycol dimethacrylate, triethylene glycol dimethacrylate, 1,4-butanediol dimethacrylate, 1,3-butanediol dimethacrylate; and polyfunctional aromatic compounds such as divinyl benzene; higher functional crosslinking monomers such as trimethyol propane trimethacrylate, pentaerythritol tetramethacrylate mixtures thereof and the like. Preferably, monomer A is ethylene glycol dimethacrylate, ethylene glycol diacrylate, or divinylbenzene. Most preferably, monomer A is ethylene glycol dimethacrylate.

Suitable ethylenically unsaturated monomers containing carboxylic acid groups which can be used as component B include acrylic monomers such as acrylic acid, methacrylic acid, ethacrylic acid, itaconic acid, maleic acid, fumaric acid; monoalkyl itaconate including monomethyl itaconate; monoethyl itaconate, and monobutyl itaconate, monoalkyl maleate including monomethyl maleate, monoethyl maleate, monobutyl maleate; citraconic acid; styrenecarboxylic acid; mixtures thereof and the like. Preferably, monomer B is acrylic acid, methacrylic acid, ethacrylic acid or itaconic acid. Most preferably, monomer B is methacrylic acid.

Suitable ethylenically unsaturated monomers other than B which can be used as component C include alkyl esters of acrylic acid or methacrylic acid, such as, methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate; the hydroxyalkyl esters of the same acids, such as, 2-hydroxyethyl acrylate, 2-hydroxyethyl methacrylate, and 2-hydroxypropyl methacrylate; the nitrile and amides of the same acids such as acrylonitrile, methacrylonitrile, acrylamide and methacrylamide; vinyl esters, such as, vinyl acetate, vinyl propionate, vinylidene chloride; vinyl chloride; and vinyl aromatic compounds, such as, styrene, t-butyl styrene, ethyl vinyl benzene, vinyl toluene; dialkyl maleates; dialkyl itaconates; dialkyl methylene-malonates; mixtures thereof and the like. Preferably, monomer C is styrene, vinyl toluene, methyl methacrylate, or ethyl methacrylate. Most preferably, monomer C is methyl methacrylate.

The matte particle surface may include reactive functional groups which form covalent bonds with binders by intermolecular crosslinking or by reaction with a crosslinking agent (i.e., a hardener). Suitable reactive functional groups include: hydroxyl, carboxyl, carbodiimide, epoxide, aziridine, vinyl sulfone, sulfinic acid, active methylene, amino, amide, allyl, and the like. There is no particular restriction on the amount of reactive groups present, but their concentrations are preferably in the range of from 0.5 to 10 weight percent. The particle surface may be surrounded with a layer of colloidal inorganic particles as described in U.S. Pat. No. 5,288,598, or a layer of colloidal polymer latex particles which have affinity with suitable binder as described in U.S. Pat. No. 5,279,934, or a layer of gelatin as described in U.S. Pat. No. 4,855,219.

Processing removable mattes can be used together with other processing surviving matte particle in the practice of the invention to further enhance the resistance of the photographic element to ferrotyping and blocking. Such processing removable mattes include particles of, for example, copolymers of alkyl (meth)acrylates and methacrylic acid, or acrylic acid, or itaconic acid, copolymers of alkyl (meth) acrylates and maleic monoesters or monoamides, copolymers of styrene or vinyl toluene and α,β-unsaturated mono- or di-carboxylic acids, or dicarboxylic monoesters or monoamides, graft copolymers containing maleic anhydride or methacrylic acid, and dicarboxylic acid mono-ester of a cellulose derivative, such as phthalate and hexahydro phthalate of methyl cellulose, hydroxyethyl cellulose, or hydroxypropyl methyl cellulose. Such processing soluble mattes are described in further detail in U.S. Pat. No. 2,992,101; 3,767,448; 4,094,848; 4,447,525; and 4,524,131.

The light-insensitive layer also includes a suitable hydrophilic binder such as naturally occurring substances such as proteins, protein derivatives, cellulose derivatives (e.g., cellulose esters), polysaccharides, casein, and the like, and synthetic water permeable colloids such as poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl sulfonic acid copolymers, vinyl imidazole copolymers, vinyl sulfide copolymers, homopolymer or copolymers containing styrene sulfonic acid, and the like. Gelatin is the most preferred hydrophilic binder.

Gelatin can be used together with other water dispersible polymers as binders in the practice of the present invention. The water dispersible polymers can be incorporated into either light-sensitive or light-insensitive layers. Suitable water dispersible polymers include both synthetic and natural water dispersible polymers. Synthetic water dispersible polymers may contain a nonionic group, an anionic group, or a nonionic group and an anionic group in the molecular structure. The nonionic group may be, for example, an ether group, an ethylene oxide group, an amide group, or a hydroxyl group. The anionic group may be, for example, a sulfonic acid group or the salt thereof, a carboxylic acid group or the salt thereof, or a phosphoric acid group or the salt thereof. The natural water soluble polymer may include a nonionic group, an anionic group, or a nonionic group and an anionic group in the molecular structure. The water dispersible polymers may be incorporated into the photographic materials of the present invention in an amount of preferably at least 0.5 percent, preferably from 1 to 50 percent, and most preferably from 2 to 30 percent based on the amount of the whole coated amount of gelatin on the side having a layer containing the matte particle of the present invention.

Water dispersible polymers useful for the present invention include vinyl polymer latex particles prepared by such as emulsion polymerization process, water-borne polyurethane dispersions, water-borne epoxy dispersions, water-borne polyester dispersions, and the like. The mean size of the dispersed particles is within the range of from 0.01 to 0.2 μm, preferably from 0.02 to 0.1 μm.

The binder should be chosen so that it effectively adheres the matte particles to the surface of the element. For a crosslinkable binder such as gelatin, the binder is preferably crosslinked so as to provide a high degree of cohesion and adhesion. Crosslinking agents or hardeners which may effectively be used in the coating compositions of the present invention include aldehydes, epoxy compounds, polyfunctional aziridines, vinyl sulfones, melamines, triazines, polyisocyanates, dioxane derivatives such as dihydroxydioxane, carbodiimides, chrome alum, zirconium sulfate, and the like.

Any lubricant can be used in the outermost layer of the present invention. Typical lubricants include (1) silicone based materials disclosed, for example, in U.S. Pat. Nos. 3,489,567; 3,080,317; 3,042,522; 4,004,927; and 4,047,958, and in British Pat. Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222; and 4,427,964; in British Patent Nos. 1,263,722; 1,198,387; 1,430,997; 1,466,304; 1,320,757; 1,320,565; and 1,320,756; and in German Patent Nos. 1,284,295 and 1,284,294; (3) liquid paraffin and paraffin or wax like materials such as carnauba wax, natural and synthetic waxes, petroleum waxes, mineral waxes and the like; (4) perfluoro- or fluoro- or fluorochloro-containing materials, which include poly(tetrafluoroethlyene), poly (trifluorochloroethylene), poly(vinylidene fluoride), poly (trifluorochloroethylene-co-vinyl chloride), poly(meth) acrylates or poly(meth)acrylamides containing perfluoroalkyl side groups, and the like. Lubricants useful in the present invention are described in further detail in Research Disclosure No. 308, published December 1989, page 1006.

The protective layer useful in the practice of the invention may optionally contain surface active agents, antistatic agents, charge control agents, thickeners, ultraviolet ray absorbers, processing removable dyes, high boiling point solvents, silver halide particles, colloidal inorganic particles, magnetic recording particles, and various other additives.

The matte-containing layer useful in the practice of the invention can be applied by any of a number of well-know techniques, such as dip coating, rod coating, blade coating, air knife coating, gravure coating and reverse roll coating, extrusion coating, slide coating, curtain coating, and the like. After coating, the protective layer is generally dried by simple evaporation, which may be accelerated by known techniques such as convection heating. Known coating and drying methods are described in further detail in Research Disclosure No. 308, Published December 1989, pages 1007 to 1008.

The photographic element of the present invention can contain an electrically conductive layer, which can be either a surface protective layer or a sub layer. The surface resistivity of at least one side of the support is preferably less than $1\times10^{12}$ Ω/square, more preferably less than $1\times10^{11}$ Ω/square at 25° C. and 20 percent relative humidity. To lower the surface resistivity, a preferred method is to incorporate at least one type of electrically conductive material in the electrically conductive layer. Such materials include both conductive metal oxides and conductive polymers or oligomeric compounds. Such materials have been described in detail in, for example, U.S. Pat. Nos. 4,203,769; 4,237,194; 4,272,616; 4,542,095; 4,582,781; 4,610,955; 4,916,011; and 5,340,676.

The present invention is also directed to a single use camera having incorporated therein a photographic element as described above. Single use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic materials are exposed in camera, and then the product is sent to the developer who removes the photographic material and develop it. Return of the product to the consumer does not normally occur.

Single-use cameras and their methods of manufacture and use are described in U.S. Pat. Nos. 4,801,957; 4,901,097; 4,866,459; 4,849,325; 4,751,536; 4,827,298; European Patent Applications 460,400; 533,785; 537,225; all of which are incorporated herein by reference.

The protective overcoat layer in accordance with this invention may be positioned over a transparent magnetic recording layer as described in U.S. Pat. Nos. 5,395,743; 5,397,826; 5,413,903; 5,432,050; 5,434,037; and 5,436,120.

The photographic processing steps to which the raw film may be subject may include, but are not limited to the following:

(1) color developing→bleach-fixing→washing/stabilizing;

(2) color developing→bleaching→fixing→washing/stabilizing;

(3) color developing→bleaching→bleach-fixing→washing/stabilizing;

(4) color developing→stopping→washing→bleaching→washing→fixing→washing/stabilizing;

(5) color developing→bleach-fixing→fixing→washing/stabilizing;

(6) color developing→bleaching→bleach-fixing→fixing→washing/stabilizing;

Among the processing steps indicated above, the steps (1), (2), (3), and (4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/125677; WO 92/07302; WO 93/00612; WO 92/07301; WO 02/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

The present invention will now be described in detail with references to examples; however, the present invention should not be limited to these examples.

EXAMPLES

Matte Particles Used in the Example Coatings are listed in Table 1.

TABLE 1

MATTE PARTICLES

| ID | Composition | Particle Size (μm) |
|---|---|---|
| M-1[a] | Poly(methyl methacrylate) | 0.8 |
| M-2[a] | Poly(methyl methacrylate) | 1.2 |
| M-3[a] | Poly(methyl methacrylate) | 1.5 |
| M-4[a] | Poly(methyl methacrylate) | 1.7 |
| M-5[a] | Poly(methyl methacrylate) | 2.2 |
| M-6[a] | Poly(methyl methacrylate) | 2.4 |
| M-7[b] | Poly(vinyl toluene) | 1.8 |
| M-8[a] | Poly(vinyl toluene-co-divinyl benzene) 80/20 | 1.5 |
| M-9[a] | Poly(vinyl toluene-co-divinyl benzene) 80/20 | 0.9 |
| M-10[a] | Poly(vinyl toluene-co-divinyl benzene) 80/20 | 1.2 |
| M-11[a] | Poly(vinyl toluene-co-divinyl benzene) 80/20 | 2.0 |
| M-12 | Poly(methyl methcarylate) | 2.5 |
| M-13 | Poly(methyl methacrylate-co-methacrylic acid) 45/55 | 3.0 |
| M-14 | Poly(methyl methacrylate-co-methacrylic acid-co-ethylene glycol dimethacrylate) 60.2/37.3/2.5 | 1.0 |
| M-15 | Poly(methyl methacrylate-co-methacrylic acid-co-ethylene glycol dimethacrylate) 59.3/39.5/1.2 | 1.0 |
| M-16 | Poly(methyl methacrylate-co-methacrylic acid-co-ethylene glycol dimethacrylate) 46/53.9/0.1 | 1.4 |
| M-17 | Poly(methyl methacrylate-co-methacrylic acid-co-ethylene glycol dimethacrylate) 45.8/53.9/0.3 | 1.4 |
| M-18 | Poly(methyl methacrylate-co-methacrylic acid-co-ethylene glycol dimethacrylate) 45.4/54/0.6 | 1.4 |
| M-19 | Poly(methyl methacrylate-co-methacrylic acid-co-ethylene glycol dimethacrylate) 44.6/54.3/1.1 | 1.4 |

[a]The matte is made in accordance with U.S. Pat. No. 4,855,219.
[b]The matte is colloidal silica covered according to U.S. Pat. No. 5,378,577.

Examples 1 to 6

A series of photographic elements are prepared as follows: A poly(ethylene naphthalate) support having an antihalation layer on one side and an antistatic layer overcoated with a transparent magnetic recording layer on the other side is coated on the antihalation layer with the following imaging forming layers in sequence.

Interlayer: This layer comprises 2,5-di-t-octyl-1,4-dihydroxy benzene (0.075 g/m$^2$), tri(2-ethylhexyl)phosphate (0.113 g/m$^2$), and gelatin (0.86 g/m$^2$).

Slow Cyan Dye-forming Layer: This layer comprises a red sensitive silver bromoiodide emulsion (3.3 mole percent iodide) (0.324 μm grain size) (0.387 g/m$^2$ silver), compound CC-1 (0.355 g/m$^2$), IR-4 (0.011 g/m$^2$), B-1 (0.075 g/m$^2$), S-2 (0.377 g/m$^2$), S-3 (0.098 g/m$^2$), and gelatin (1.64 g/m$^2$).

Mid Cyan Dye-forming Layer: This layer comprises a blend of a red sensitive silver bromoiodide emulsion (3.3 mole percent iodide) (0.488 μm grain size) (0.816 g/m$^2$ silver) and a red sensitive, tabular grain, silver bromoiodide emulsion (4.5 mole percent iodide) (0.98 μm diameter by 0.11 μm thick) (0.215 g/m$^2$ silver), compound CC-1 (0.183 g/m$^2$), IR-3 (0.054 g/m$^2$), B-1 (0.027 g/m$^2$), CM-1 (0.011 g/m$^2$), S-2 (0.183 g/m$^2$), S-3 (0.035 g/m$^2$), S-5 (0.054 g/m$^2$), and gelatin (1.35 g/m$^2$).

Fast Cyan Dye-forming Layer: This layer comprises a red sensitive, tabular grain, silver bromoiodide emulsion (4.5 mole percent iodide) (1.10 μm diameter by 0.11 μm thick) (1.08 g/m$^2$ silver), compound CC-1 (0.161 g/m$^2$), IR-3 (0.038 g/m$^2$), IR-4 (0.038 g/m$^2$), CM-1 (0.032 g/m$^2$), S-2 (0.237 g/m$^2$), S-5 (0.038 g/m$^2$), and gelatin (1.35 g/m$^2$).

Interlayer: This layer comprises 2,5-di-t-octyl-1,4-dihydroxy benzene (0.075 g/m$^2$), tri(2-ethylhexyl)phosphate (0.113 g/m$^2$), and gelatin (0.86 g/m$^2$).

Slow Magenta Dye-forming Layer: This layer comprises a blend of a green sensitive, tabular grain, silver bromoiodide emulsion (1.5 mole percent iodide) (0.7 μm diameter by 0.112 μm thick) (0.258 g/m$^2$ Ag), and a green sensitive, tabular grain, silver bromoiodide emulsion (1.3 mole percent iodide) (0.54 μm diameter by 0.086 μm thick) (0.409 g/m$^2$ Ag), compound M-1 (0.204 g/m$^2$), MM-1 (0.038 g/m$^2$), ST-1 (0.020 g/m$^2$), S-1 (0.26 g/m$^2$), and gelatin (1.18 g/m$^2$).

Mid Magenta Dye-forming Layer: This layer comprises a green sensitive, tabular grain, silver bromoiodide emulsion (4.5 mole percent iodide) (0.61 μm diameter by 0.12 μm thick) (0.646 g/m$^2$ Ag), compound M-1 (0.099 g/m$^2$), MM-1 (0.027 g/m$^2$), IR-2 (0.022 g/m$^2$), ST-1 (0.010 g/m$^2$), S-1 (0.143 g/m$^2$), S-2 (0.044 g/m$^2$), and gelatin (1.41 g/m$^2$).

Fast Magenta Dye-forming Layer: This layer comprises a green sensitive; tabular grain, silver bromoiodide emulsion (4.5 mole percent iodide) (0.98 μm diameter by 0.113 μm thick) (0.699 g/m$^2$ Ag), compound M-1 (0.052 g/m$^2$), MM-1 (0.032 g/m$^2$), IR-2 (0.022 g/m$^2$), ST-1 (0.005 g/m$^2$), S-1 (0.111 g/m$^2$), S-2 (0.044 g/m$^2$), and gelatin (1.123 g/m$^2$).

Yellow Filter Layer: This layer comprises 2,5-di-t-octyl-1,4-dihydroxy benzene (0.075 g/m$^2$), YD-2 (0.108 g/m$^2$), Irganox 1076 sold by Ciby Geigy (0.01 g/m$^2$), S-2 (0.121 g/m$^2$) and gelatin (0.861 g/m$^2$).

Slow Yellow Dye-forming Layer: This layer comprises a blend of a blue sensitive, tabular grain, silver bromoiodide emulsion (4.5 mole percent iodide) (1.4 μm diameter by 0.131 μm thick) (0.161 g/m$^2$ Ag), a blue sensitive, tabular grain, silver bromoiodide emulsion (1.5 mole percent iodide) (0.85 μm diameter by 0.131 μm thick) (0.0.108 g/m$^2$ Ag), and a blue sensitive, tabular grain, silver bromoiodide emulsion (1.3 mole percent iodide) (0.54 μm diameter by 0.086 μm thick) (0.161 g/m$^2$ Ag), compound Y-1 (0.915 g/m$^2$), IR-1 (0.032 g/m$^2$), B-1 (0.0065 g/m$^2$), S-1 (0.489 g/m$^2$), S-3 (0.0084 g/m$^2$), and gelatin (1.668 g/m$^2$).

Fast Yellow Dye-forming Layer: This layer comprises a blue sensitive, tabular grain, silver bromoiodide emulsion (4.5 mole percent iodide) (2.3 μm diameter by 0.128 μm thick) (0.43 g/m$^2$ Ag), compound Y-1 (0.15 g/m$^2$), IR-1 (0.032 g/m$^2$), B-1 (0.0054 g/m$^2$), S-1 (0.091 g/m$^2$), S-3 (0.0070 g/m$^2$), and gelatin (0.753 g/m$^2$).

UV Protective Layer: This layer comprises compound UV-1 (0.111 g/m$^2$), UV-2 (0.111 g/m$^2$)S-4 (0.222 g/m$^2$), silver bromide Lippmann emulsion (0.215 g/m$^2$ Ag), and gelatin (0.7 g/m$^2$).

Y1

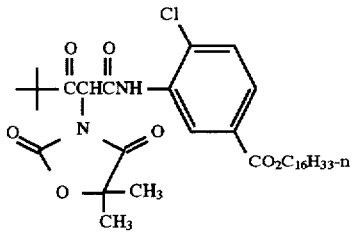

-continued

IR-1

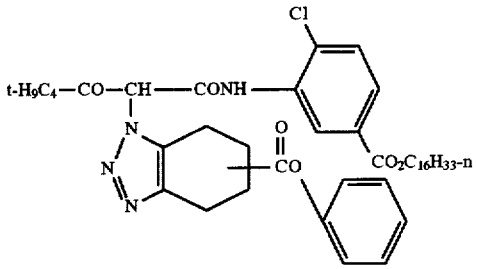

YD-2

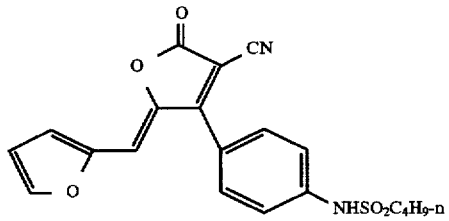

ST-1

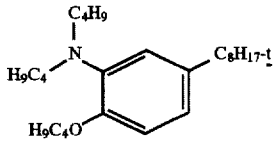

IR-2

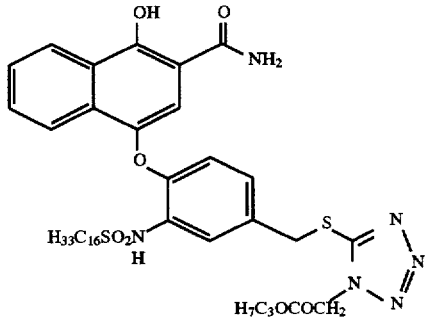

IR-3

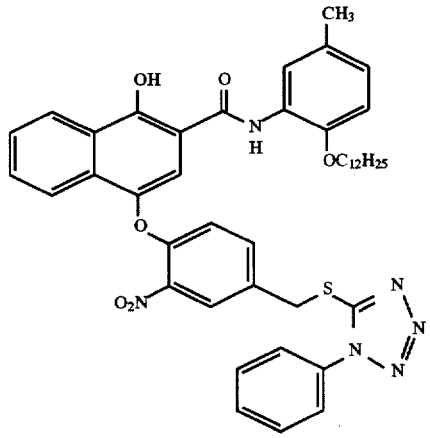

-continued
IR-4
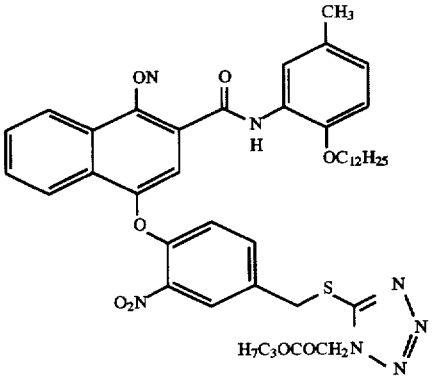
B-1
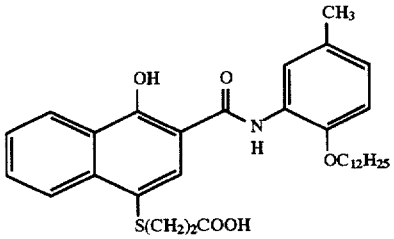
M-1
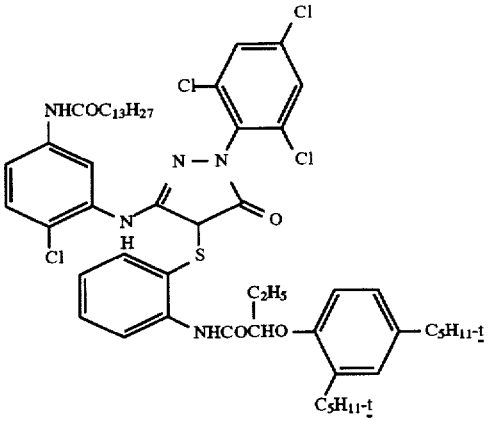
MM-1
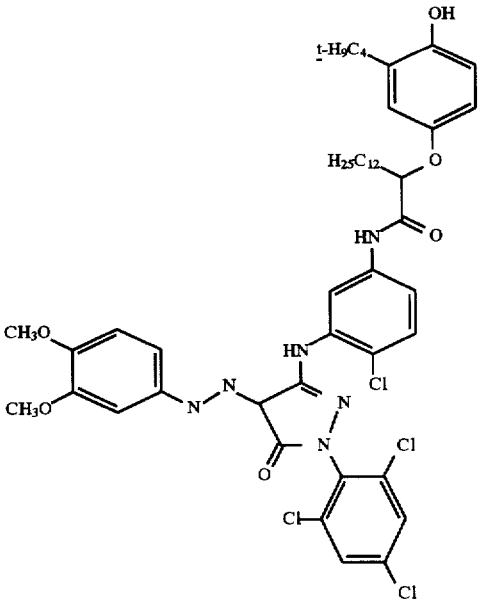
-continued
CC-1
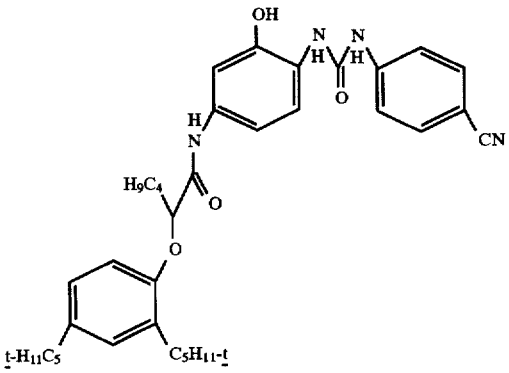
CM-1
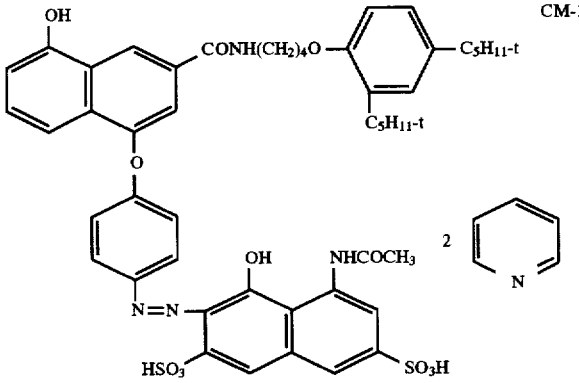
S-1
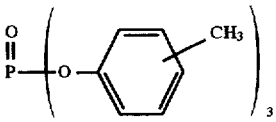
S-2
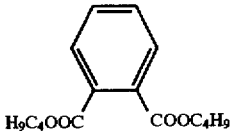
S-3
$C_{11}H_{23}CON(C_2H_5)_2$
S-4
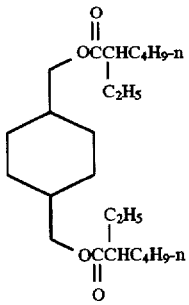
S-5
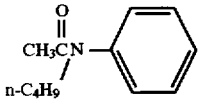
UV-1
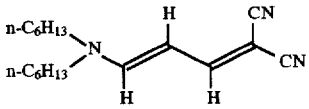

-continued

UV-2

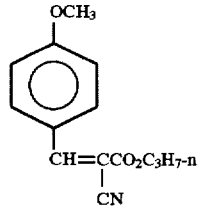

Preparation of Light-Insensitive Layer

A light-insensitive layer containing gelatin binder and matting agents listed in Table 1 is coated on the top of the UV layer and has the following composition:

TABLE 2

| COMPOSITION OF THE LIGHT-INSENSITIVE LAYER (DRY WEIGHT) | |
|---|---|
| Gelatin, lime processed | 888 mg/m$^2$ |
| Silicone lube, DC-200 (Dow Corning) | 40.1 mg/m$^2$ |
| Fluorad FC-134 (3M Co.) | 3.9 mg/m$^2$ |
| Aerosol OT (American Cyanamide) | 21.5 mg/m$^2$ |
| Surfactant Olin 10G (Olin Corp.) | 27.2 mg/m$^2$ |
| Matte 1 (Table 3) | |
| Matte 2 (Table 3) | |

Table 3 shows the compositions of the light-insensitive layer of each photographic element prepared.

TABLE 3

| | Matte 1 | Coverage (mg/m$^2$) | Matte 2 | Coverage (mg/m$^2$) |
|---|---|---|---|---|
| Example 1 (Comparison) | M-8 | 53.8 | M-13 | 107.6 |
| Example 2 (Invention) | M-16 | 53.8 | M-13 | 107.6 |
| Example 3 (Invention) | M-17 | 53.8 | M-13 | 107.6 |
| Example 4 (Invention) | M-18 | 53.8 | M-13 | 107.6 |
| Example 5 (Invention) | M-19 | 53.8 | M-13 | 107.6 |
| Example 6 (Comparison) | M-3 | 53.8 | M-13 | 107.6 |

Evaluation of the Surface Roughness

The surface roughness is evaluated by using a Gould Microtopographer 200, which measures the surface roughness in terms of the number of peaks per centimeter as a function of distance above the mean line. The peak is defined as the point of maximum height on that portion of a profile which lies above the mean line and between two intersections of the profile and the meanline (ANSI B46.1-1978). The result is reported in Table 4 as peaks per centimeter (PPCM) at a distance of 0.13 μm above the mean line.

Evaluation of the Abrasion Resistance

To evaluate the abrasion resistance of the protective overcoat, discs of coatings after processing are placed on a Taber Abrader and abraded in accordance with ASTM method D1044. Since the outermost layer contains matting agents, the measurement based on percentage light transmission or difference in percentage haze (Delta Haze) before and after Taber abrasion cannot be used to measure the abrasion resistance of the coatings. Instead, a Gould Microtopographer 200 is used to measured the surface roughness within the track area of the samples after Taber abrasion. The surface roughness is then analyzed in terms of two parameters: PPCM which counts the number of scratches produced by Taber wheels per centimeter and Ra which accounts for the average surface roughness. The product of the two (Ra×PPCM) is used here to quantify the extent of surface scratches. The larger the Ra×PPCM value, the poorer the scratch resistance of the sample. The results are summarized in Table 4.

Evaluation of Ferrotyping Resistance

A group of six 35 mm strips having a length of 305 mm (12 inches) of the feature film (raw or processed) are placed in a 70 percent or 80 percent relative humidity (RH) chamber for a minimum of 16 hours. The strips are stacked, sensitized side to unsensitized side and wrapped in foil, placed inside a moisture proof wrap, and sealed. The sealed package is then placed above a flat glass plate and under a brass bar of the same size with weight of 6.89 Kgs (15 lbs). The package, with the glass plate and brass bar is then placed in a 37.8° C. (100° F.) room for 17 hours. After storage, the bag is opened, the top and bottom strips are discarded, and the remaining strips are visually inspected for ferrotyping against the following scale:

| Value | % of area showing ferrotyping |
|---|---|
| A | 0 to <5 |
| B | 5 to <20 |
| C | 20 to <50 |
| D | 50 to 100 |

The testing results are reported in Table 4.

TABLE 4

| | PPCM (Mild)[a] | PPCM (Harsh)[b] | PPCM Change (%) | Ra x PPCM | Ferrotyping[c] 80% RH |
|---|---|---|---|---|---|
| Example 1 (Comparison) | 401 | 309 | 23 | 9.3 | B |
| Example 2 (Invention) | 538 | 477 | 11.3 | 7.8 | A |
| Example 3 (Invention) | 563 | 503 | 10.7 | 6.7 | A |
| Example 4 (Invention) | 530 | 507 | 4.3 | 7.5 | A |
| Example 5 (Invention) | 510 | 476 | 6.7 | 7.1 | A |
| Example 6 (Comparison) | 419 | 328 | 22 | 6.1 | B |

The comparison Examples 1 and 6 contain a 1.5 μm poly(vinyl toluene-co-divinyl benzene) matte and a 1.5 μm poly(methyl methacrylate) matte, respectively. They show a significant loss in the element protective surface roughness upon harsh drying (60° C. and 2 minutes). On the other hand, Invention Examples 2 to 5 contain matte particles of the present invention, and the change in their surface roughness upon harsh drying is much smaller. In other words, the photographic elements in accordance with the present invention have unexpectedly robust performance in photofinishing laboratories.

Examples 7 to 19

Examples 7 to 19 are prepared as in Examples 1 to 6 except the light-insensitive protective layer which has the composition shown in Table 5.

TABLE 5

| COMPOSITION OF THE LIGHT-INSENSITIVE LAYER (DRY WEIGHT) | |
|---|---|
| Gelatin, lime processed | 888 mg/m$^2$ |
| Silicone lube, DC-200 (Dow Corning) | 40.1 mg/m$^2$ |
| Fluorad FC-134 (3M Co.) | 3.9 mg/m$^2$ |
| Aerosol OT (American Cyanamide) | 21.5 mg/m$^2$ |
| Surfactant Olin 10G (Olin Corp.) | 27.2 mg/m$^2$ |
| Matte 1 (Table 6) | |

Both ferrotyping protection and surface roughness for these elements are evaluated in a similar way to those for Examples 1 to 6. The results are reported in Table 6.

Evaluation of the RMS Granularity

The graininess of a photographic picture is caused primarily by the developed dye clouds, image silver and light scatter from matting agents in the protective overcoat layers. The Root Mean Square (RMS) Granularity is evaluated by the method described in ANSI Ph 2.40 (1985) entitled "Root Mean Square (RMS) Granularity of Film (images on One Side Only)-Method for Measurement". By comparing RMS Granularity of the listed samples with a film that contains no matte, the granularity due to the matte is determined. The test results are reported in Table 6.

TABLE 6

| | Matte | Coverage (mg/m$^2$) | PPCM (Mild) | PPCM (Harsh) | Increase in RMS Granularity | Ferrotyping[a] 80% RH/ 37.8° C. |
|---|---|---|---|---|---|---|
| Example 7 (Comparison) | M-1 | 107.6 | 309 | 151 | 1 | D |
| Example 8 (Comparison) | M-2 | 107.6 | 736 | 504 | 1 | B |
| Example 9 (Comparison) | M-3 | 107.6 | 663 | 578 | 2 | B |
| Example 10 (Comparison) | M-5 | 107.6 | 638 | 526 | 4 | A |
| Example 11 (Comparison) | M-7 | 107.6 | 479 | 307 | 8 | B |
| Example 12 (Comparison) | M-8 | 107.6 | 653 | 347 | 6 | B |
| Example 13 (Comparison) | M-9 | 107.6 | 389 | 205 | 1 | C |
| Example 14 (Comparison) | M-10 | 107.6 | 633 | 433 | 2 | B |
| Example 15 (Comparison) | M-11 | 107.6 | 482 | 433 | 8 | B |
| Example 16 (Comparison) | M-12 | 107.6 | 336 | 296 | 6 | B |
| Example 17 (Comparison) | M-14 | 107.6 | 771 | 746 | 1 | B |
| Example 18 (Invention) | M-15 | 107.6 | 811 | 815 | 1 | A |
| Example 19 (Invention) | M-17 | 107.6 | — | — | 1 | A |

[a]Ferrotyping test is done on the harsh dried processed films.

Above examples contain matte particles of different sizes and compositions. Clearly, only those examples which contain matte particles in accordance with the present invention show both good RMS printing granularity and superior ferrotyping performance.

Examples 20 to 24

Examples 20 to 24 (Table 7) are prepared as in Examples 1 to 6. These examples show benefits of use of a combination of matte particles of the present invention with other processing surviving matting agents.

TABLE 7

| | Matte 1 Coverage | Matte 2 Coverage | Increase in RMS Granularity | Ferrotyping[a] 80% RH/ 37.8° C. |
|---|---|---|---|---|
| Example 20 (Comparison) | M-2 53.8 mg/m$^2$ | M-13 107.6 mg/m$^2$ | 0.5 | C |
| Example 21 (Comparison) | M-4 53.8 mg/m$^2$ | M-13 107.6 mg/m$^2$ | 1.5 | C |
| Example 22 (Comparison) | M-4 107.6 mg/m$^2$ | M-13 107.6 mg/m$^2$ | 3.0 | A |
| Example 23 (Invention) | M-2 53.8 mg/m$^2$ | M-18 107.6 mg/m$^2$ | 0.5 | A |
| Example 24 (Invention) | M-4 53.8 mg/m$^2$ | M-18 107.6 mg/m$^2$ | 1.5 | A |

[a]Ferrotyping test is done on the harsh dried processed films.

Comparison Examples 20 and 21 contain 53.8 mg/m$^2$ of a 1.2 μm poly(methyl methacrylate) matte and a 1.7 μm poly(methyl methacrylate) matte, respectively, in combination with a processing removable matte (M-13). They show good RMS printing granularity. However, their ferrotyping performance is poor. Comparison Example 22 contains 107.6 mg/m$^2$ of the 1.7 μm poly(methyl methacrylate) matte in combination with the processing removable matte. It has good ferrotyping performance but unacceptable RMS printing granularity invention Examples 23 and 24 contain 53.8 mg/m$^2$ of a 1.2 μm poly(methyl methacrylate) matte and a 1.7 μm poly(methyl methacrylate) matte, respectively, in combination with the matte particle in accordance with the present invention. Clearly, the use of an additional 107.6 mg/m$^2$ of matte particle of the present invention does not lead to an increase in RMS printing granularity. In this regard, the matte particles of present invention are comparable to a processing removable matte. However, the matte particles of the present invention are processing survival matte as evidenced by the unexpectedly excellent post process ferrotyping performance of invention Examples 23 and 24.

What is claimed is:

1. A photographic imaging element comprising a support, at least one light-sensitive silver halide layer, and a light-insensitive layer comprising a polymer particle of the formula:

$$(A)_x(B)_y(C)_z \quad (I)$$

where A is a polyfunctional ethylenically unsaturated crosslinking monomer, B is an ethylenically unsaturated monomer containing carboxylic acid groups, C is a monofunctional ethylenically unsaturated monomer other than B, x is about 0.1 to 2 mole percent, y is about 35 to 70 mole percent and z equals 100–(x+y) mole percent.

2. The photographic element of claim 1 wherein the light-insensitive layer includes a hydrophilic binder.

3. The photographic element of claim 2 wherein the hydrophilic binder is gelatin.

4. The photographic element of claim 1 wherein the polymer particle has a mean size of 0.5 to 10 μm.

5. The photographic element of claim 1 wherein the polymer particle has a mean size of 0.5 to 6 μm.

6. The photographic element of claim 1 wherein the polymer particle has a mean size of 0.8 to 3 μm.

7. The photographic element of claim 1 wherein monomer A is ethylene glycol dimethacrylate, ethylene glycol diacrylate or divinyl benzene.

8. The photographic element of claim 1 wherein monomer B is acrylic acid, methacrylic acid, ethacrylic acid or itaconic acid.

9. The photographic element of claim 1 wherein monomer C is styrene, vinyl toluene, methyl methacrylate or ethyl methacrylate.

10. A photographic material comprising a cassette containing a processed photographic element of claim 1.

* * * * *